US009070371B2

(12) United States Patent
Brajbhushan et al.

(10) Patent No.: US 9,070,371 B2
(45) Date of Patent: Jun. 30, 2015

(54) METHOD AND SYSTEM FOR PEAK LIMITING OF SPEECH SIGNALS FOR DELAY SENSITIVE VOICE COMMUNICATION

(71) Applicant: ITTIAM SYSTEMS (P) LIMITED, Bangalore (IN)

(72) Inventors: Kumar Brajbhushan, Malangawa (JP); Naveen Cherala, Bangalore (IN)

(73) Assignee: ITTIAM SYSTEMS (P) LTD., Bangalore, Karnataka (IN)

( * ) Notice: Subject to any disclaimer, the term of this patent is extended or adjusted under 35 U.S.C. 154(b) by 359 days.

(21) Appl. No.: 13/656,770

(22) Filed: Oct. 22, 2012

(65) Prior Publication Data

US 2014/0114654 A1 Apr. 24, 2014

(51) Int. Cl.
*G10L 21/00* (2013.01)
*G10L 21/034* (2013.01)

(52) U.S. Cl.
CPC ..... *G10L 21/034* (2013.01)

(58) Field of Classification Search
CPC ..... G10L 21/0316; G10L 21/0324; G10L 21/0332; G10L 21/034
See application file for complete search history.

(56) References Cited

U.S. PATENT DOCUMENTS 4,466,119 A * 8/1984 Peters et al. ..... 381/108
5,267,322 A * 11/1993 Smith et al. ..... 381/107
5,471,651 A * 11/1995 Wilson ..... 455/72
5,832,444 A * 11/1998 Schmidt ..... 704/500
5,917,865 A * 6/1999 Kopmeiners et al. ..... 375/345
6,741,966 B2 * 5/2004 Romesburg ..... 704/500
8,019,105 B2 * 9/2011 Kates ..... 381/321
2002/0019733 A1 * 2/2002 Erell ..... 704/225
2005/0091040 A1 * 4/2005 Nam et al. ..... 704/201
2006/0126865 A1 * 6/2006 Blamey et al. ..... 381/102
2006/0149541 A1 * 7/2006 Jaklitsch et al. ..... 704/226
2009/0271185 A1 * 10/2009 Smithers et al. ..... 704/225
2010/0017203 A1 * 1/2010 Archibald ..... 704/208
2010/0114569 A1 * 5/2010 Zhang et al. ..... 704/225
2011/0268301 A1 * 11/2011 Nielsen et al. ..... 381/321
2012/0071127 A1 * 3/2012 Tsukamoto et al. ..... 455/234.1
2013/0024193 A1 * 1/2013 Yeldener et al. ..... 704/225

* cited by examiner

*Primary Examiner* — Brian Albertalli
(74) *Attorney, Agent, or Firm* — Prakash Nama; Global IP Services, PLLC

(57) ABSTRACT

A method and system for peak limiting of speech signals for delay sensitive voice communication is disclosed. In an embodiment, a position of a sample with highest magnitude within a current block of samples is determined. Further, a peak gain to be applied for the current block of samples to bring down the highest magnitude to a predetermined threshold value is determined. Furthermore, a gain delta by which an old gain is updated to the peak gain is computed. Then, a gain factor is computed for the current block of samples based on the position of the sample with highest magnitude and the gain delta. Subsequently, the gain factor is set to a predetermined minimum gain factor when the computed gain factor is less than the predetermined minimum gain factor. In addition, gain is applied to the current block of samples using the gain factor.

19 Claims, 11 Drawing Sheets

METHOD AND SYSTEM FOR PEAK LIMITING OF SPEECH SIGNALS FOR DELAY SENSITIVE VOICE COMMUNICATION

TECHNICAL FIELD

Embodiments of the present subject matter relate to speech processing. More particularly, embodiments of the present subject matter relate to method and system for peak limiting of speech signals for delay sensitive voice communication.

BACKGROUND

Generally, speech processing systems deal with a variety of signals with varying intensity levels. Exemplary speech processing systems may include mobile phones, audio recorders, Voice over Internet Protocol (VOIP) systems etc. A person using the speech processing systems may speak at different audible levels at different instants in time. The variation in audio/speech signals may occur when the person changes the position with respect to the microphone of the speech processing system or if there is sudden and transient increase in the audio level. Such transient increase in the audio level may exceed the dynamic range of the audio processing system, thereby producing distorted audio output.

The term "peak limiting", commonly used in signal processing, handles such signal bursts or transients in the audio signals. Further, the signal level is maintained below some predefined threshold, particularly during such transients. This has been a common practice for audio signal processing that is needed for audio content production and listening requirements.

In existing methods, the focus has been on to reduce the distortions caused in the audio quality during the peak limiting process. One generic approach to handle the transients is to delay the signals sufficiently such that future transients are anticipated and attenuated in time. In the audio signal used for entertainment, there was less focus on reducing the processing delay of the signals. However, for a voice communication system for interactivity and reducing the impact of acoustic echo feedback, it is desired that signal processing delay be minimal or preferably no delay should be introduced.

Further, a major section of voice communication systems is packet based communication like Voice over IP (VoIP) system. In the packet based communication, the speech signal is processed at block level or frame level. Hence, there is need for a method that can handle the speech signal transients without introducing any delay and with minimal distortion in signal quality, while processing at frame level as desired in the existing signal flow in the voice communication systems.

BRIEF DESCRIPTION OF THE DRAWINGS

Various embodiments are described herein with reference to the drawings, wherein.

Figure 1:
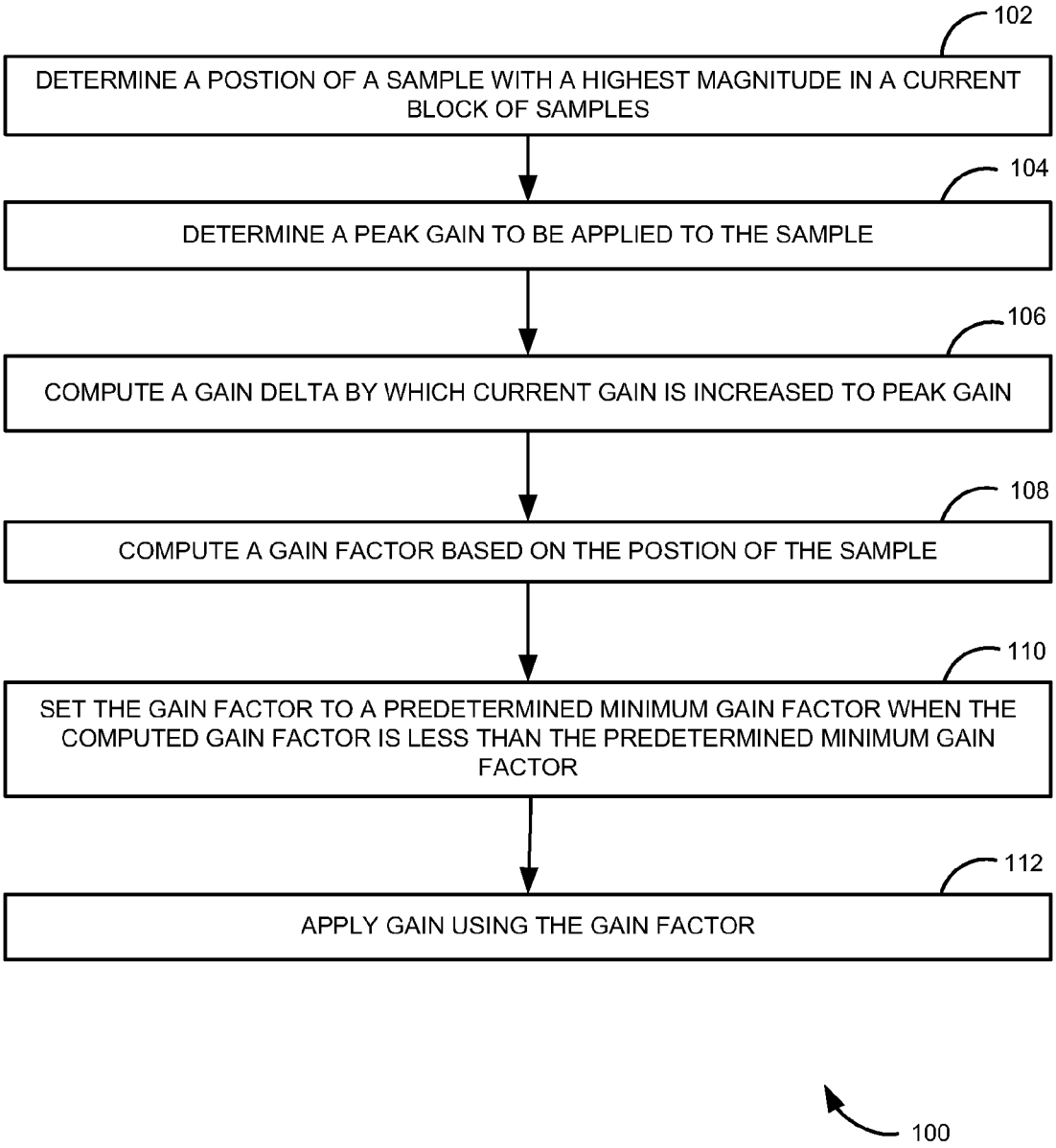
FIG. 1 illustrates a flowchart of a method for peak limiting of speech signals in a block of samples, according to one embodiment.

The systems and methods disclosed herein may be implemented in any means for achieving various aspects. Other features will be apparent from the accompanying drawings and from the detailed description that follow.

DETAILED DESCRIPTION

A method and system for peak limiting of speech signals for delay sensitive voice communication are disclosed. In the following detailed description of the embodiments of the present subject matter, references are made to the accompanying drawings that form a part hereof, and in which are shown by way of illustration specific embodiments in which the present subject matter may be practiced. These embodiments are described in sufficient detail to enable those skilled in the art to practice the present subject matter, and it is to be understood that other embodiments may be utilized and that changes may be made without departing from the scope of the present subject matter. The following detailed description is, therefore, not to be taken in a limiting sense, and the scope of the present subject matter is defined by the appended claims.

The terms "frame" and "block" are used interchangeably throughout the document. Further, the terms "speech" and "audio" are used interchangeably throughout the document.

Peak limit process generally refers to handling the transient part of the signal mainly the peak level. The idea is to apply quick attenuation to the transient and peak level of the signal to bring it below a predefined threshold. This is expected to avoid possible distortions later in the signal path. In case of audio signal, it refers to avoiding distortions in audio recording and audio reproduction parts.

Once the transient part of the signal is reduced below the predefined threshold to avoid distortions, the applied attenuation should also be gradually removed so that overall signal level goes back to original signal level. This step of reducing or releasing the applied attenuation is referred as peak-release process in the following description. In the current description, peak-release process is described as integral part of overall peak limiting process. However, in literature and implementations peak-release process may be independent of the peak limiting process.

For peak limiting process, the power level of the signal can be any function of the signal. One representation can be smoothened power level of the signal. In the current description, the individual samples are taken as representative of the signal power level. Accordingly, the pre-defined threshold is taken as limit at a sample level.

One major challenge of the peak limiting process is to quickly identify the place when the signal level is crossing the pre-defined threshold and attenuate the signal such that the signal does not cross the pre-defined threshold. One of the key features of the current invention is that it identifies the samples crossing the pre-defined threshold and attenuates the signal without adding any processing delay. Another aspect of this invention is that it describes the peak limit process with respect to block level processing which is commonly used in Voice over IP (VoIP) communication.

FIG. 1 illustrates a flowchart 100 of a method for peak limiting of speech signals in a block of samples, according to one embodiment. The speech signals are divided into blocks or frames of samples, for example, blocks/frames of 10 milliseconds (ms) or 20 ms in length. At step 102, a position of a sample with highest magnitude within a current block of samples is determined. At step 104, a peak gain to be applied for the current block of samples to bring down the highest magnitude to a predetermined threshold value is determined. In one example embodiment, the peak gain is computed as follows.

peak gain=(predetermined peak threshold)/(highest magnitude in block).

At step 106, a gain delta by which an old gain is updated (i.e., reduced) to the peak gain is computed. Note that in this case, peak gain may be less than the old gain and this means reducing the gain. In one example embodiment, the gain delta is computed using the following equation:

gain delta=peak gain/old gain, where, the old gain is a gain at an end of the previous block of samples.

At step 108, a gain update rate or a gain factor is computed for the current block of samples based on the position the sample with highest magnitude and the gain delta. The gain factor is computed using the equation:

$$\text{gain factor} = \text{gain delta}^{\frac{1}{\text{peak index}}},$$

where, the gain factor refers to a factor by which gain values get updated, the gain delta refers to a fractional change in gain, and the peak index is an index value of the position of the sample with highest magnitude in current block of samples.

At step 110, the gain factor is set to a predetermined minimum gain factor only when the computed gain factor is less than the predetermined minimum gain factor. The predetermined minimum gain factor is the maximum rate by which gain values are decreased at a sample level. If the computed gain factor is below the predetermined minimum gain factor, the gain factor is set/limited to the predetermined minimum gain factor to avoid any distortions. In an exemplary scenario, the value of the predetermined minimum gain factor is −0.5 dB/ms.

The predetermined minimum gain factor is the highest attenuation (i.e., gain reduction) rate that does not cause any distortion or introduces acceptable distortion. For speech processing, a pitch period characteristic can be used to derive the minimum gain factor. It is observed that over one pitch period, maximum increase in sample level is about 1 dB. Also, the minimum pitch period is about 2 ms. Hence for handling the transients, the gain should decrease at the rate of 1 dB per 2 ms. This effectively means a gain increase rate of −0.5 dB/ms. For different use cases, the minimum gain factor can be determined considering signal characteristics and acceptable quality distortion. Similarly, for peak release process, an acceptable maximum rate of gain increase considered is +0.1 dB/ms.

At step 112, gain is applied to the current block of samples using the gain factor. Before applying the gain factor, the process determines whether a peak gain for the current block of samples is reached. If the peak gain is not reached, a gain is updated at each sample in the current block of samples based on the gain factor using the equation:

updated gain=gain*gain factor, where, the gain is the gain applied to a previous sample, and the gain factor is same as the gain factor computed at step 110. Further, the updated gain is applied to a current sample. Furthermore, the steps of determining, updating and applying gain are repeated until the peak gain is reached. When the peak gain is reached, the gain (at which the peak gain is reached) is applied to the remaining samples in the current block of samples. In other words, the gain update is stopped once the peak gain is reached. The step 112 is explained in detail in FIG. 5. Additionally, the gain update is on the hold until hangover period is over for performing peak-release process.

Figure 2:
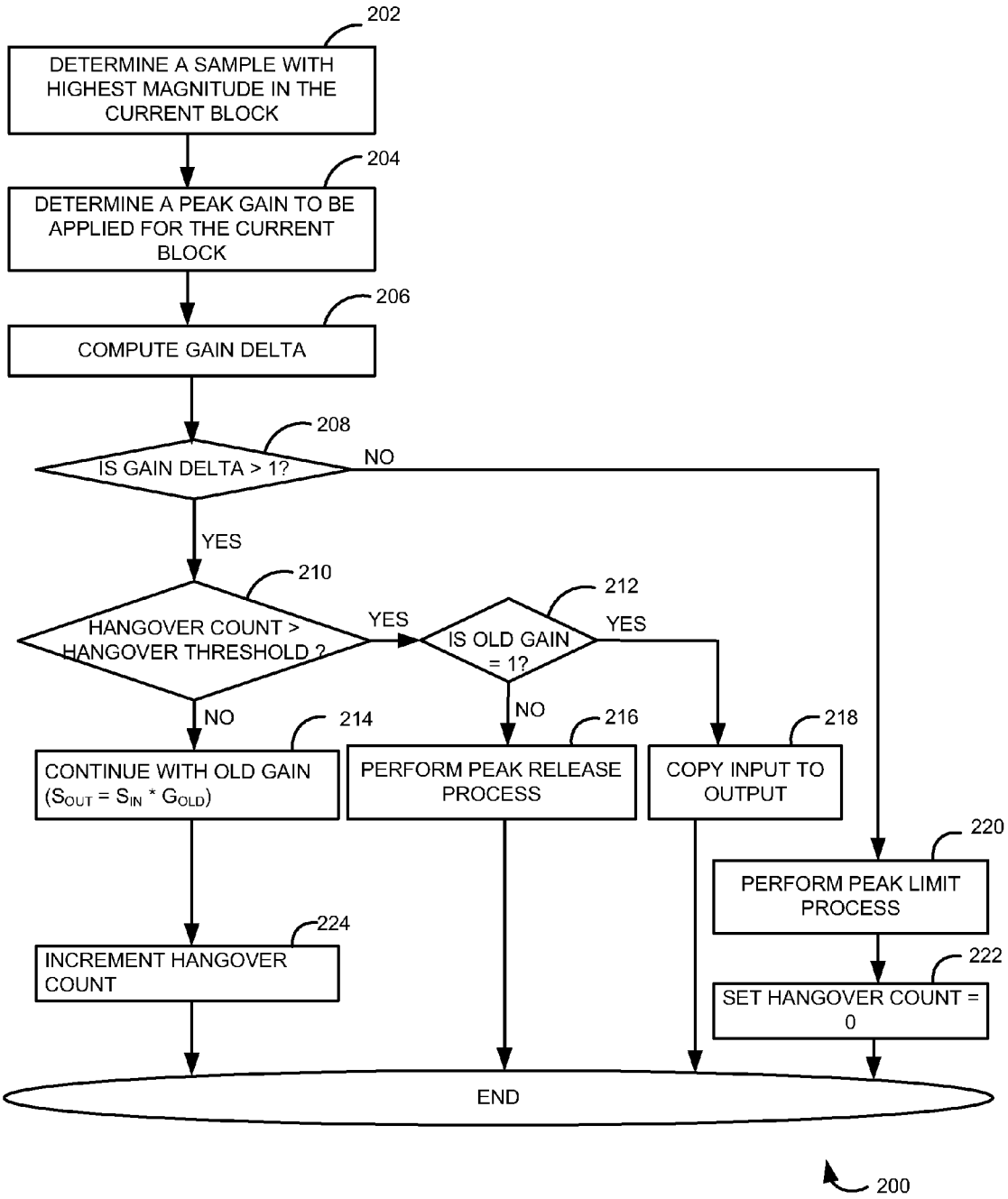
FIG. 2 illustrates a flowchart of a method for block level processing of speech signals, according to one embodiment.

Referring now to FIG. 2, which is a flowchart 200 illustrating a method for block level processing of speech signals, according to one embodiment. At step 202, a position of a sample with highest magnitude within a current block of samples is determined. At step 204, a peak gain to be applied for the current block of samples to bring down the highest magnitude to a predetermined threshold value is determined.

At step 206, a gain delta is computed. At step 208, a check is performed to determine if the computed gain delta is greater than 1. If the gain delta is greater than 1, at step 210, a check is performed to determine if a hangover count value is greater than a hangover threshold value. The hangover count is used to determine whether a hangover wait period is over. Only after the hangover period, increase in gain is allowed as part of peak-release process. If the increase in gain is allowed just after the sample where peak gain is reached (during peak limiting), there is a higher probability of some subsequent samples crossing the peak threshold especially on the rising edge of signal burst. Once the samples cross peak threshold, peak limiting needs to me performed again. Therefore, hangover wait is performed to make sure that there are no undue gain fluctuations. If the hangover count value is greater than the hangover threshold value, at step 212, a check is performed to determine if the old gain is equal to 1. If the old gain is equal to 1, at step 218, the input samples are reproduced as output samples. The reason for this step is that gain cannot be increased beyond 1, that is, unity gain. With the unity gain, the output samples will be same as the input samples. If the old gain is not equal to 1, at step 216, a peak release process is performed to increase the gain towards unity. The peak release process is explained in detail with reference to FIG. 4. Referring to step 210, if the hangover count value is not greater than the hangover threshold value, at step 214, the old gain is applied to the current block of samples using the equation:

$$S_{out}=S_{in}*g_{old},$$

where, $S_{out}$ is the output sample, $S_{in}$ is the input sample and $g_{old}$ is the old gain.

At step 224, the hangover count is incremented. If the gain delta is not greater than 1 (at step 208), then a peak limit process is performed at step 220 and then a status flag "hangover count" is set to zero at step 222. The peak limit process is explained in detail with reference to FIGS. 3A-3B.

Figure 3A:
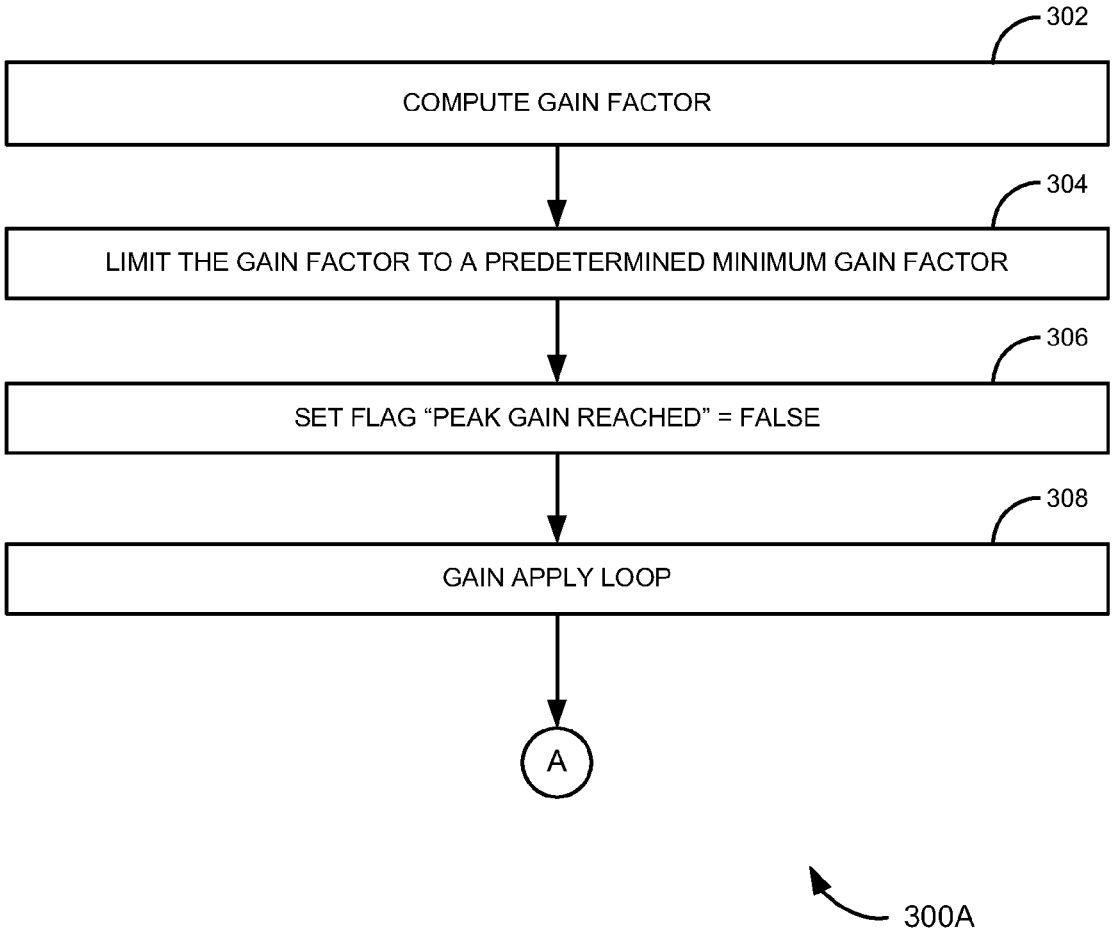
FIG. 3A and FIG. 3B illustrate flowcharts of a method for peak limiting of speech signals in the block of samples, according to one embodiment.
Figure 3B:
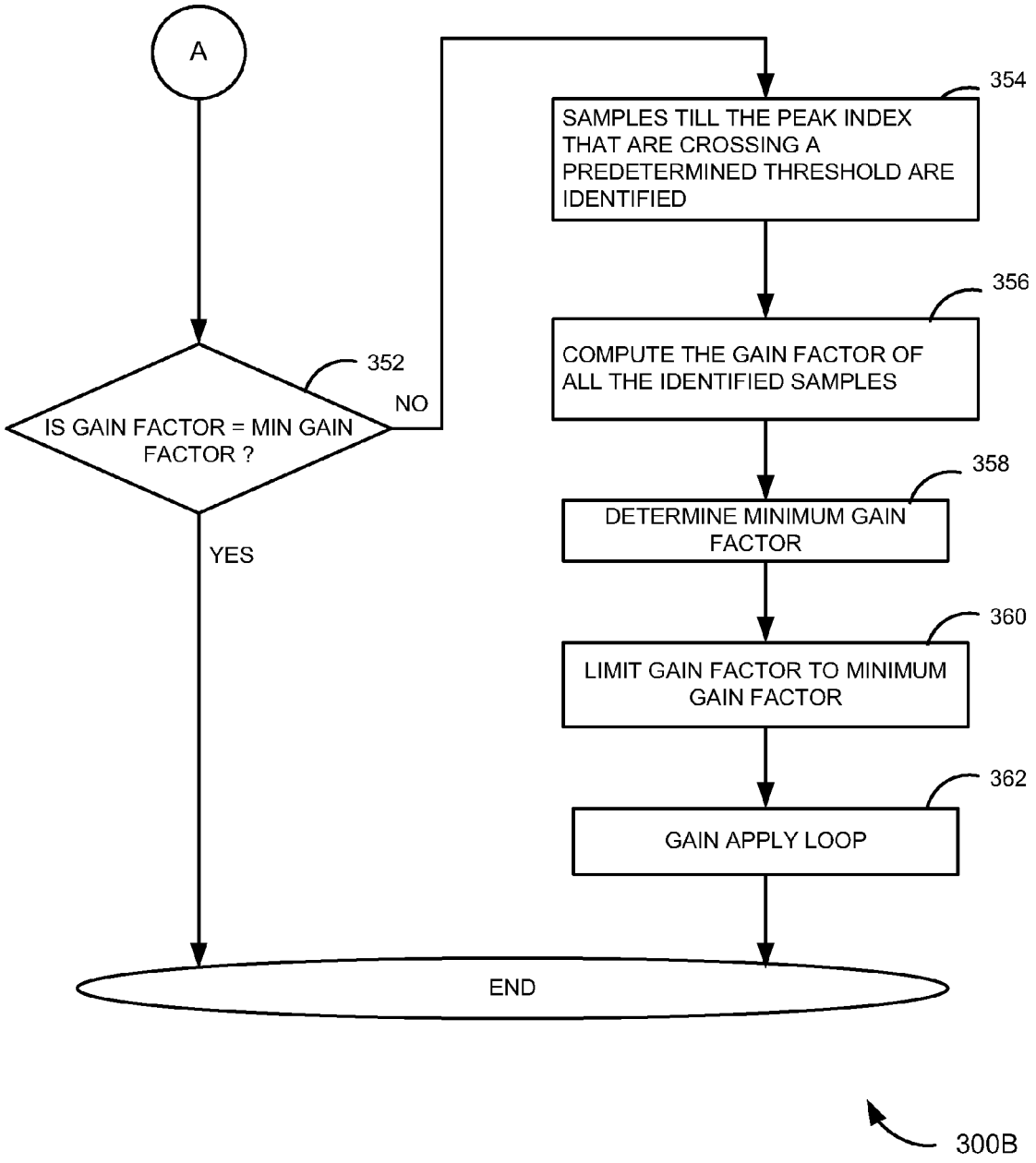

FIG. 3A and FIG. 3B illustrate flowcharts of a method for peak limiting of speech signals in the current block of samples (e.g., as described in step 220 of FIG. 2), according to one embodiment. Particularly FIG. 3A is a flow chart 300A illustrating a method for peak limiting of speech signals based on a peak sample in the current block of samples, according to one embodiment. At step 302, the gain factor is computed for the current block of samples based on the position the sample with highest magnitude and the gain delta. At step 304, the gain factor is limited to the predetermined minimum gain factor if the gain factor is below the predetermined minimum gain factor. At step 306, a flag "peak-limit-reached" is set to false and the process goes to step 308. At step 308, gain is applied to the current block of samples using the gain factor. The gain apply process is explained in detail with respect to FIG. 5.

Referring now to FIG. 3B, which is a flowchart 300B illustrating a method for peak limiting of speech signals based on multiple peak samples exceeding a peak threshold value in the current block of samples, according to one embodiment. FIG. 3B is a continuation of the peak limiting method of FIG. 3A. At step 352, a check is performed to determine if the gain factor (e.g., computed in step 306 of FIG. 3A) is equal to the predetermined minimum gain factor. If the gain factor equals the minimum gain factor, then the gain factor cannot be further reduced. If the gain factor is not equal to the predetermined minimum gain factor, at step 354, all samples in the current block crossing the predetermined threshold value upon applying the gain are identified.

Process explained in flowchart 300B (FIG. 3B) is relatively compute intensive process. The decision for when to refine the peak limit process using the method described in flowchart 300B (FIG. 3B), beyond general peak limit method of flowchart 300A (FIG. 3A), can be based on a number of times sample values cross the soft peak limit (also referred as "predetermined threshold") and the hard peak limit. The number of times sample values cross the soft peak limit and the hard peak limit is explained in detail as a part of sample level update process in step 662 of FIG. 6B.

In this case, the samples till the peak index only need to be considered. The reason is that the gain factor of the samples beyond the peak index is always more than the gain factor of the peak sample.

At step 356 a gain factor is computed for each of the identified samples. In these embodiments, the process starts with an initial count of n equal 0 and incrementing the count by 1. The index of the samples crossing the predetermined threshold are identified using the equation:

$$\text{index}=\text{peak cross index}[n],$$

where, the peak cross index[n] refers to an index of sample n which cross the peak threshold.

Further, gain factor of each of the identified samples based on respective magnitudes of the identified samples is computed using the following equations. Here, peak gain[n] and gain delta[n] have their usual meaning with respect to $n^{th}$ identified sample. Also, $S_{in}$ [index] is the value of the identified input sample.

$$\text{peak gain}[n]=(\text{predetermined peak threshold})/(\text{magnitude of } S_{in}[\text{index}]), \text{ and}$$

$$\text{gain delta}[n]=(\text{peak gain}[n])/(\text{oldgain}).$$

Subsequently, the gain factor is computed for each of the identified samples based on the computed gain delta and respective positions of the identified samples using the equation below:

$$\text{gain factor } [n] = \text{gain delta } [n]^{\frac{1}{index}}.$$

At step 358, a minimum gain factor is determined from the computed gain factors associated with the identified samples. At step 360, the minimum gain factor is set to the predetermined minimum gain factor when the minimum gain factor is less than predetermined minimum gain factor. At step 362, the gain factor is applied to the current block of samples.

Figure 4:
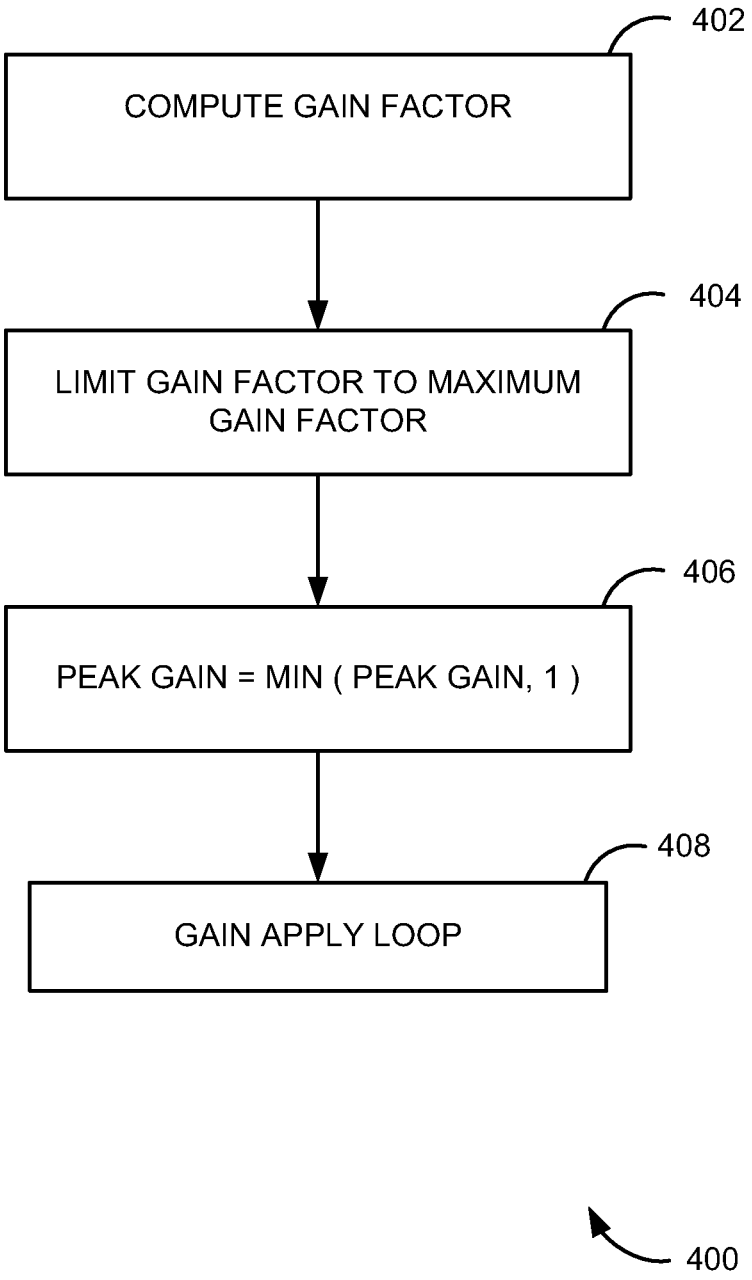
FIG. 4 illustrates a flowchart of a method for performing peak release of speech signals in the block of samples, according to one embodiment.

Referring now to FIG. 4, which illustrates a flowchart of a method for performing peak release of speech signals in the current block of samples, according to one embodiment. Particularly, FIG. 4 is a flowchart 400A illustrating a method for performing peak release of speech signals based on the peak sample in the current block of samples, according to one embodiment. The peak release process takes place when the gains of the samples need to increase towards a unit level. The peak release process starts after the hangover wait period as explained in FIG. 2. At step 402, a gain factor is computed for a current block of samples based on a position of the sample with highest magnitude and the gain delta. If the gain factor is greater than a predetermined maximum gain factor, at step 404, the gain factor is limited to the predetermined maximum gain factor. In these embodiments, a maximum rate of increase of gain is limited to the predetermined maximum gain factor. An absolute rate of increase in gain is maintained lower than the rate of decrease in gain (i.e., peak limit process). In an exemplary embodiment, the value of the predetermined maximum gain factor is +0.1 dB/ms. At step 406, a peak gain is limited to a minimum of peak gain and 1. In other words, the peak gain is limited to upper limit of 1. At step 408, gain is applied to the current block of samples using the computed gain factor.

Figure 5:
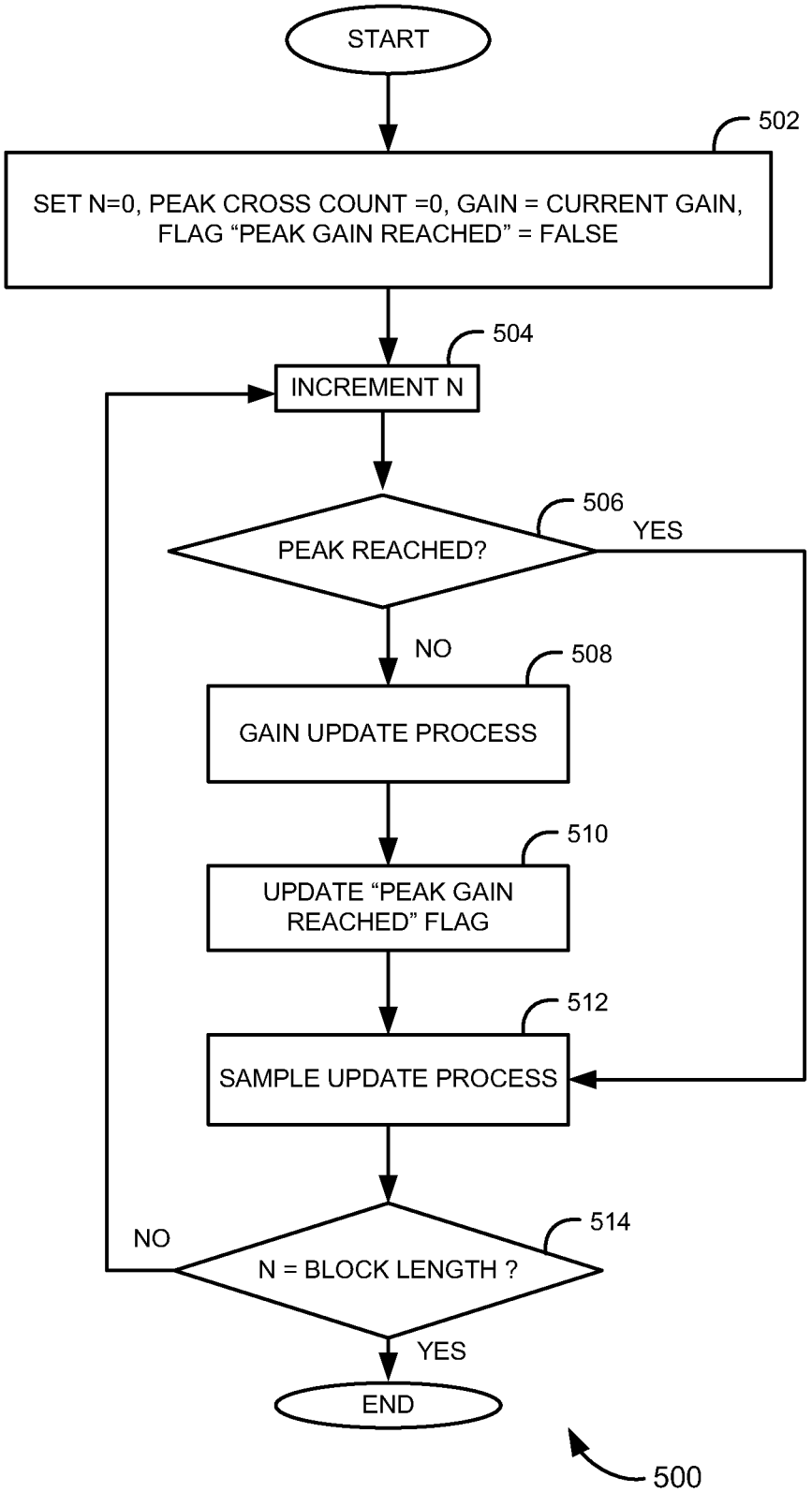
FIG. 5 illustrates a flowchart of a method for applying the gain for the block of samples, according to one embodiment.

Referring now to FIG. 5, which is a flowchart 500 illustrating a method for applying the gain for the current block of samples, according to one embodiment. Gain apply loop is a sample level loop, where gain is applied individually to each sample in the current block of samples. The gain apply loop is started with the initial conditions n (count)="0", peak cross count="0", gain="old gain" and peak gain reached flag="FALSE" (step 502). Where n refers to an index for the samples, the peak cross count represents the number of samples crossing the peak threshold, and gain is used to update gain for a first sample. Further, peak gain reached flag tracks whether the peak gain is reached and upon reaching the peak gain for the current block, further updates to gain can be avoided.

At step 504, the value of n is incremented. At step 506, a check is performed to determine if a peak gain is reached for a sample in the current block of samples. If the peak gain is not reached, at step 508, a gain at the sample in the current block of samples is updated based on the gain factor and subsequently the "peak gain reached" flag is updated at step 510. The gain update process is explained in detail in FIG. 6A. At step 512, the gain value is applied to the sample to compute an output sample. The sample update process is explained in detail in FIG. 6B. If the peak gain is reached at step 506, the gain value is directly applied to the sample and the output sample is computed as shown in step 512.

At step 514, a check is performed to determine whether the value of n (i.e., count value) is equal to the length of the current block of samples. If n is not equal to the length of the current block of samples, the process increments the value of n at step 504 and goes to step 506 until the value of n is equal to the length of the current block of samples.

Figure 6A:
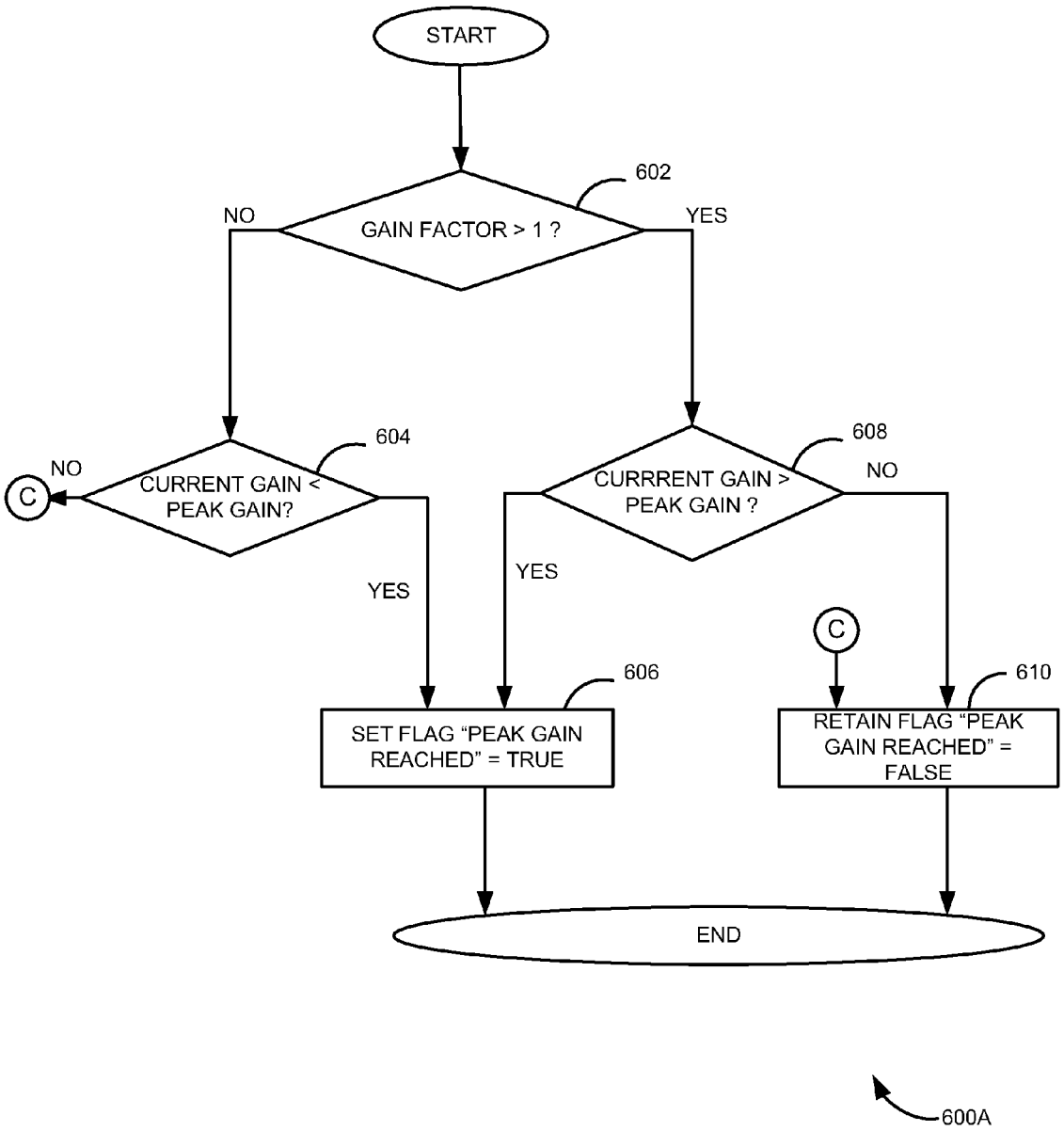
FIG. 6A illustrates a flowchart of a method for checking when the gain reaches a peak gain, according to one embodiment.

Referring now to FIG. 6A, which is a flowchart 600 illustrating a method for updating gain and checking if the gain has reached the peak gain, according to one embodiment. The check for reaching to the peak gain is made for both the peak limiting process explained in FIGS. 3A-3B and peak release process explained in FIG. 4. At step 602, a check is performed to determine if a gain factor is greater than 1. If the gain factor is not greater than 1, the peak gain is checked for the peak limit process where at step 604, another check is performed to determine if a gain is less than the peak gain. If the gain is less than the peak gain, the "peak gain reached flag" is set to TRUE at step 606. If the gain is not less than the peak gain, the "peak gain reached flag" is retained to FALSE at step 610.

If the gain factor (at step 602) is greater than 1, the peak gain is checked for the peak release process where at step 608, a check is made to determine whether the gain is greater than the peak gain. If the gain is greater than the peak gain, at step 606, the "peak gain reached flag" is set to TRUE. If the gain is not greater than the peak gain, the "peak gain reached flag" is retained to FALSE at step 610.

Figure 6B:
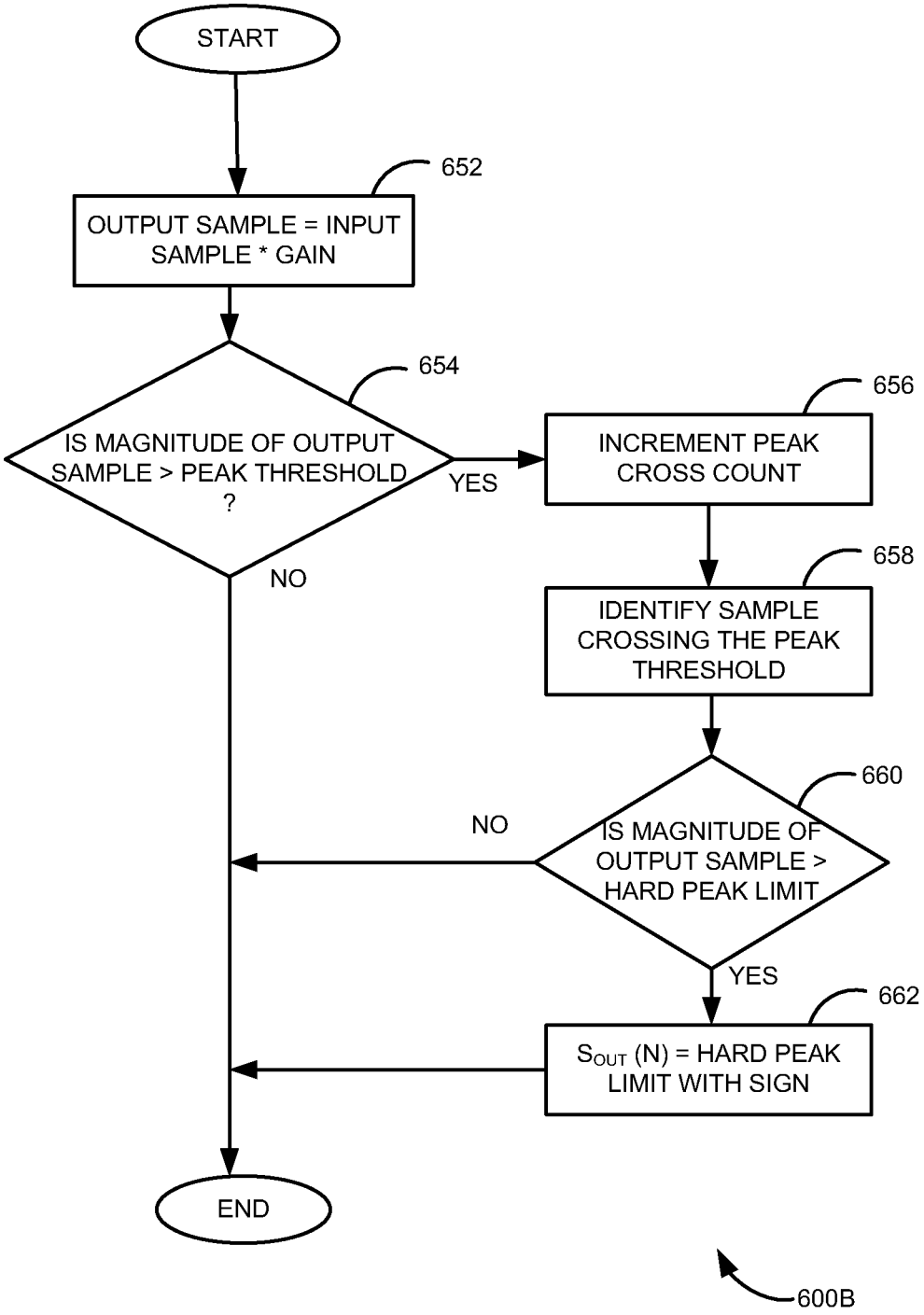
FIG. 6B illustrates a flowchart of a method for updating each sample, according to one embodiment.

FIG. 6B illustrates a flowchart of a method for updating each sample, according to one embodiment. Particularly, FIG. 6B illustrates the sample update process (e.g., step 512 of FIG. 5) in detail. At step 652, the gain is applied to each sample using the equation:

output sample=input sample*gain, where, the gain refers to computed gain corresponding to the input sample at consideration.

At step 654, a check is made to determine whether a magnitude of a computed output sample is greater than a peak threshold in the current block of samples. When the magnitude of the output sample is greater than the peak threshold, the peak cross count is incremented at step 656 and the output sample crossing the peak threshold is identified by noting the index of the output sample, at step 658. At step 660, a check is made to determine whether the magnitude of the output sample is greater than hard peak limit. If the magnitude of output sample is greater than hard peak limit, then the output sample ($S_{out}$ (n)) is limited/set/updated to the hard peak limit with the sign of value being same as the sign of output sample, at step 662. Note that, predetermined peak threshold is also referred as soft peak limit. It is desired that to avoid quality distortions output sample values be within the soft peak limit. However, few samples can cross the soft peak without seriously impacting the quality. In comparison, all output sample values must be within the hard peak limit else audio quality will be seriously impacted. The number of samples that cross the hard peak limit can also be found similar to the way the number of samples crossing the soft peak limit (peak cross count) is found.

Figure 7:
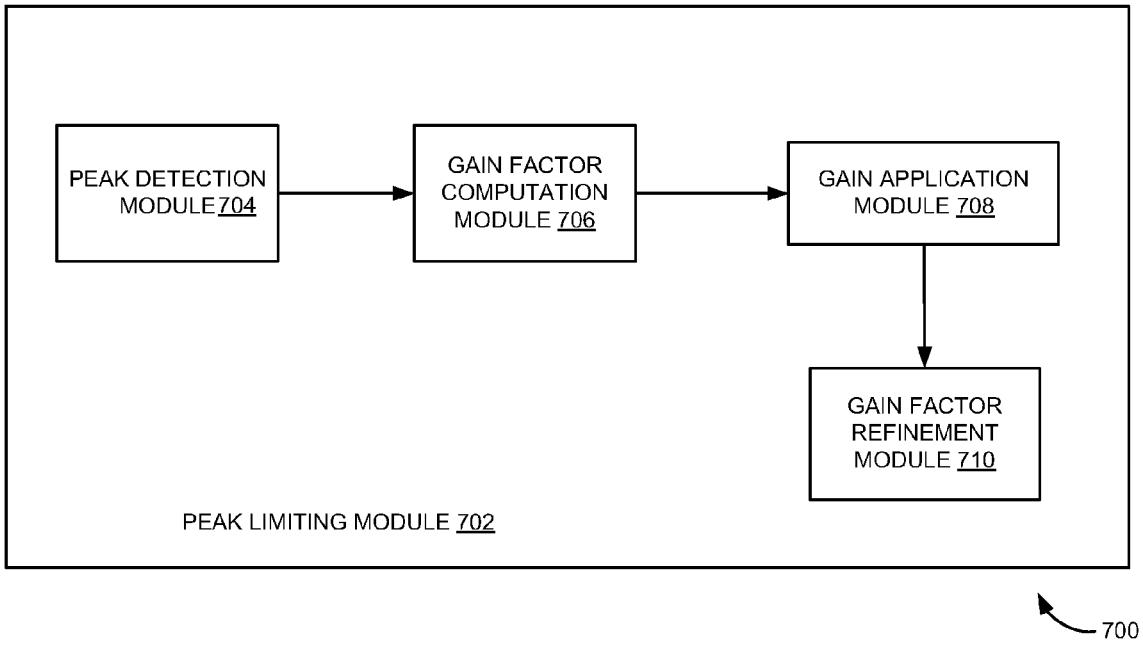
FIG. 7 illustrates a block diagram of a peak limiting module, according to one embodiment.

Referring now to FIG. 7, which is a block diagram 700 illustrating a peak limiting module 702, according to one embodiment. Particularly, the peak limiting module 702 includes a peak detection module 704, a gain factor computation module 706, a gain application module 708 and a gain factor refinement module 710.

In operation, the peak detection module 704 is configured to determine a position of a sample with highest magnitude within a current block of samples. The gain factor computation module 706 is configured to determine a peak gain to be applied for the block of samples for bringing the highest magnitude to a predetermined threshold value. Further, the gain factor computation module 706 computes a gain delta by which an old gain is updated to the peak gain. The old gain is a gain at an end of the previous block of samples. Further, the gain factor computation module 706 computes a gain factor for the current block of samples based on the position of the sample with highest magnitude and the gain delta. After computing the gain factor, the gain factor computation module 706 sets the gain factor to a predetermined minimum gain factor when the computed gain factor is less than the predetermined minimum gain factor.

The gain application module 708 is configured to update gain at sample level and apply the gain to corresponding sample within the block of samples. In one example embodiment, the gain application module 708 determines whether a peak gain is reached in the current block of samples. If the peak gain is not reached, the gain application module 708 updates a gain at each sample in the current block of samples based on the gain factor. Further, the updated gain is applied to each sample in the current block of samples. Furthermore the gain application module 708 repeats the steps of determining, updating and applying gain until the peak gain is reached.

The gain factor refinement module 710 is configured to identify a plurality of samples till a peak index that are crossing the predetermined threshold value upon applying the gain to the current block of samples. Further, the gain factor refinement module 710 computes a gain delta for each of the identified samples based on respective magnitudes of the identified samples. Furthermore, the gain factor refinement module 710 computes a gain factor for each of the identified samples based on the computed gain delta and respective positions of the identified samples. Further the gain factor refinement module 710 determines a minimum gain factor from the computed gain factors associated with the identified samples. Also, the gain factor refinement module 710 sets the minimum gain factor to the predetermined minimum gain factor when the minimum gain factor is less than predetermined minimum gain factor. In addition, the gain application module 708 applies the computed gain to the current block of samples.

Figure 8:
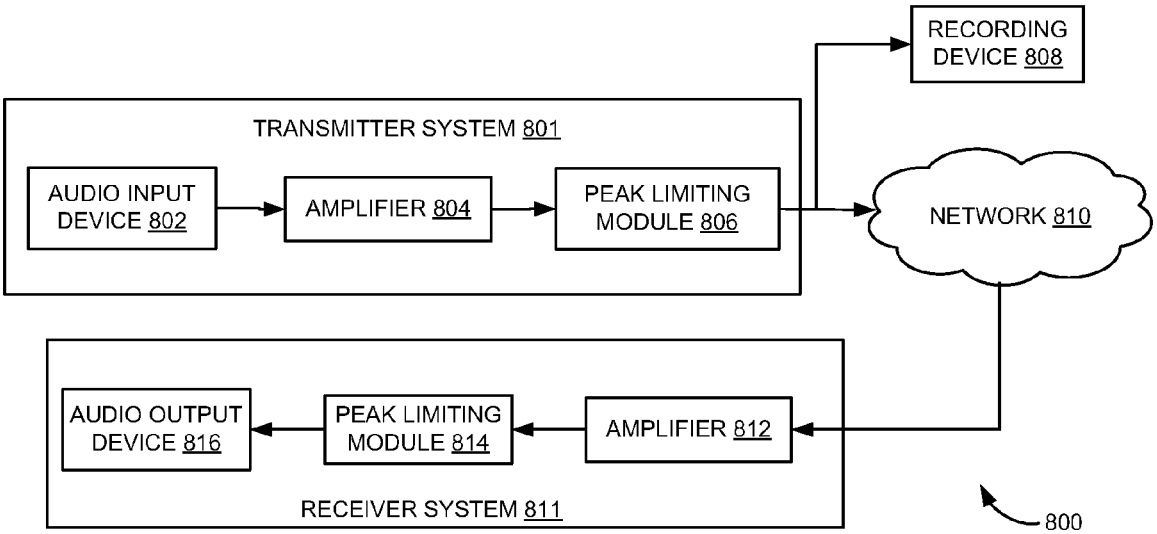
FIG. 8 illustrates a block diagram of a speech processing system incorporating the peak limiting module, according to one embodiment.

Referring now to FIG. 8, which is a block diagram 800 illustrating a speech processing system incorporating the peak limiting module (such as the peak limiting module 702 of FIG. 7), according to one embodiment. The speech processing system includes an audio transmitter system 801 communicatively connected to an audio receiver system 811 via a network 810. In one example embodiment, the peak limiting module can be used in the transmitter system 801, receiver system 811 and/or at both transmitter and receiver systems. As shown in FIG. 8, the transmitter system 801 includes an audio input device 802, an amplifier 804, and a peak limiting module 806 and the receiver system 811 includes an amplifier 812, a peak limiting module 814, and an audio output device 816.

At transmitter end, a speech is captured by audio input device 802. The audio input device may convert the analog speech signal into its digital counterpart using analog to digital conversion circuitry. Further, the speech signal is amplified by the amplifier 804. Further the speech signal is processed by the peak limiting module 806 to mitigate any transients in the speech signal by varying the gain factor applied to the samples in the speech signal. The peak limiting module 806 performs peak limiting process (as explained in FIGS. 3A and 3B) and peak release process (as explained in FIG. 4) based on the magnitude and position of samples in a block of samples. However, if an automatic gain control is part of the speech processing system 800 that uses the output of the peak limiting module 806 then the peak-release process may not be needed.

In one example embodiment, the processed speech signal is recorded at a recording device 808. The recording device 808 may include, for example, a voice recorder, mobile phone, music system. In another example embodiment, the processed speech is transmitted over the network 810 to the receiver system 811 which can also perform the peak limit process. The peak limiting modules 806 and 814 are similar to the peak limiting module 702 as explained with reference to FIG. 7.

Figure 9:
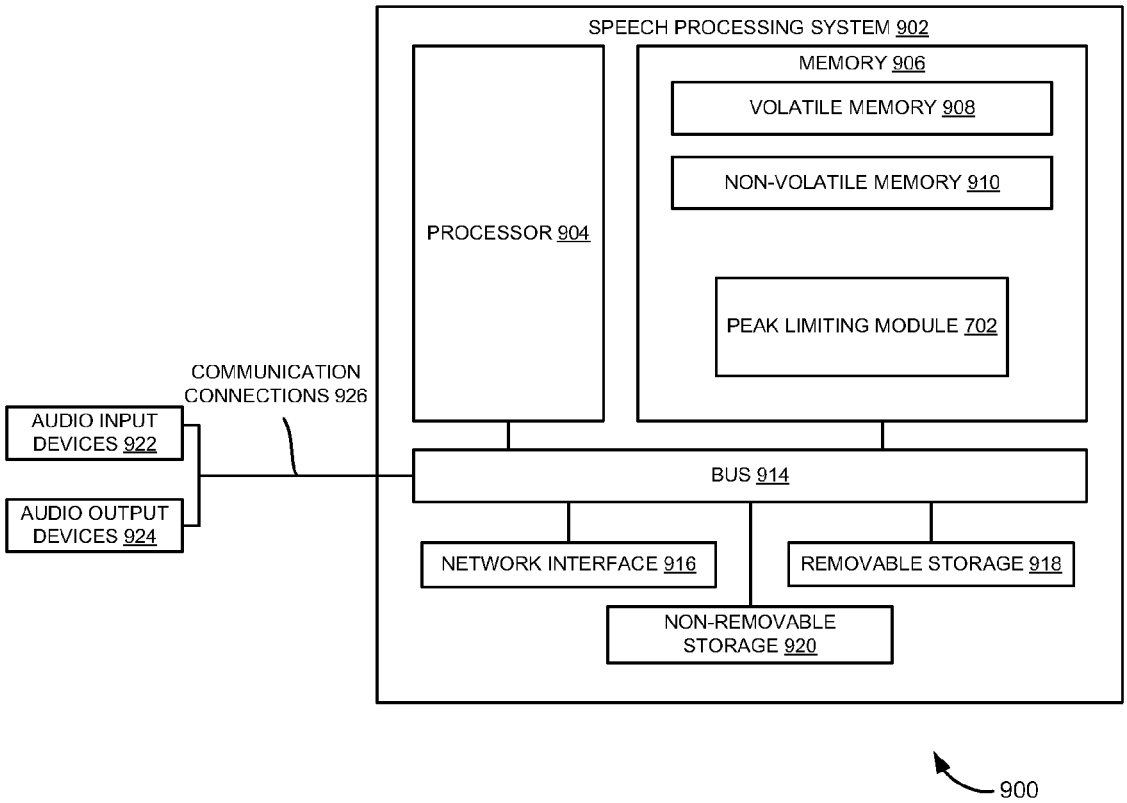
FIG. 9 is a system view illustrating a physical computing device having the peak limiting module, according to one embodiment.

Referring now to FIG. 9, which is a block diagram 900 illustrates a speech processing system 902 including a peak limiting module 702 for peak limiting speech signals in delay sensitive voice communication encountered in the speech processing system, according to one embodiment. FIG. 9 and the following discussions are intended to provide a brief, general description of a suitable computing environment in which certain embodiments of the inventive concepts contained herein are implemented.

The speech processing system 902 includes a processor 904, memory 906, a removable storage 918, and a non-removable storage 920. The speech processing system 902 additionally includes a bus 914 and a network interface 916. As shown in FIG. 9, the speech processing system 902 includes access to the computing system environment 900 that includes one or more user input devices 922, one or more output devices 924, and one or more communication connections 926 such as a network interface card and/or a universal serial bus connection.

Exemplary audio input devices 922 include a microphone, a Musical Instrument Digital Interface (MIDI) keyboard and the like. Exemplary audio output devices 924 include speakers, earphones, headphones and the like. Exemplary communication connections 926 include a local area network, a wide area network, and/or other networks.

The memory 906 further includes volatile memory 908 and non-volatile memory 910. A variety of computer-readable storage media are stored in and accessed from the memory elements of the speech processing system 902, such as the volatile memory 908 and the non-volatile memory 910, the removable storage 918 and the non-removable storage 920. The memory elements include any suitable memory device(s) for storing data and machine-readable instructions, such as read only memory, random access memory, erasable programmable read only memory, electrically erasable programmable read only memory, hard drive, removable media drive for handling compact disks, digital video disks, diskettes, magnetic tape cartridges, memory cards, Memory Sticks™, and the like.

The processor 904, as used herein, means any type of computational circuit, such as, but not limited to, a microprocessor, a microcontroller, a complex instruction set computing microprocessor, a reduced instruction set computing microprocessor, a very long instruction word microprocessor, an explicitly parallel instruction computing microprocessor, a graphics processor, a digital signal processor, or any other type of processing circuit. The processor 904 also includes embedded controllers, such as generic or programmable logic devices or arrays, application specific integrated circuits, single-chip computers, smart cards, and the like.

Embodiments of the present subject matter may be implemented in conjunction with program modules, including functions, procedures, data structures, and application programs, for performing tasks, or defining abstract data types or low-level hardware contexts. Machine-readable instructions stored on any of the above-mentioned storage media may be executable by the processor 904 of the speech processing system 902. For example, the memory 906 includes machine-readable instructions capable of peak limiting speech signals for delay sensitive voice communication generated in the speech processing system 902, according to the teachings and herein described embodiments of the present subject matter. In one embodiment, the memory may include a compact disk-read only memory (CD-ROM) and loaded from the CD-ROM to a hard drive in the non-volatile memory 910. Machine-readable instructions in the memory 906 cause the peak limiting module 702 to operate according to the various embodiments of the present subject matter.

As shown, the memory 906 includes a peak limiting module 702. For example, the peak limiting module 702 can be in the form of instructions stored on a non-transitory computer-readable storage medium. When the instructions in the non-transitory computer-readable storage medium are executed by a computing device, causes the speech processing system 902 to perform the one or more methods and systems described with reference to FIGS. 1 through 8.

Thus, the described method and system provides a method for peak limiting speech signals for delay sensitive voice communication. The described method and system applies fast attenuation in order to avoid samples from going beyond a peak threshold. The described method and system is implemented in a block processing manner which is advantageous in digital domains like Voice over Internet Protocol (VoIP) applications. Further, the method and system provides a peak release process where the gain is increased back to unity level. Furthermore, the method and system does not introduce any additional delay caused by incorporating look-ahead feature. Additionally, the method and system uses pitch information to determine the rate of attenuation (gain factor) which is effective for speech and certain musical content.

Although certain methods, systems, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. A method for peak-limiting of a speech signal for delay sensitive voice communication comprising:

determining a position of a sample with highest magnitude within a current block of samples of the speech signal by a processor;

determining a peak gain to be applied for the current block of samples to bring down the highest magnitude to a predetermined threshold value by the processor;

computing a gain delta by which an old gain is updated to the peak gain by the processor;

computing a gain factor for the current block of samples by the processor based on the position of the sample with highest magnitude and the gain delta;

setting the gain factor to a predetermined minimum gain factor by the processor when the computed gain factor is less than the predetermined minimum gain factor; and applying gain to the current block of samples of the speech signal using the gain factor by the processor.

2. The method of claim 1, wherein the gain delta is computed using the equation $$\text{gain delta}=\text{peak gain}/\text{old gain},$$

wherein the old gain refers to a gain at the end of previous block of samples.

3. The method of claim 1, wherein the gain factor is computed using the equation:

$$\text{gain factor} = \text{gain delta}^{\frac{1}{\text{peak index}}},$$

wherein the gain factor refers to a factor by which gain values get updated, the gain delta refers to a fractional change in gain, and the peak index is an index value of the position of the sample with highest magnitude.

4. The method of claim 1, wherein applying the gain to the current block of samples comprises:

determining whether the peak gain is reached in the current block of samples;

if the peak gain is not reached in the current block of samples, updating the gain at each sample in the current block of samples based on the gain factor;

applying the updated gain to each sample in the current block of samples; and repeating the steps of determining, updating and applying until the peak gain is reached.

5. The method of claim 4, further comprising:

upon the peak gain is reached in the current block of samples, applying the gain to remaining samples in the current block of samples.

6. The method of claim 4, wherein the gain is updated at each sample in the current block of samples using the equation:

$$\text{updated gain}=\text{gain}*\text{gain factor}.$$

7. The method of claim 1, further comprising:

determining whether the gain factor is equal to the predetermined minimum gain factor; and when the gain factor is not equal to the predetermined minimum gain factor, identifying samples till a peak index that are crossing the predetermined threshold value upon applying the gain to the current block of samples;

computing a gain delta for each of the identified samples based on respective magnitudes of the identified samples;

computing a gain factor for each of the identified samples based on the computed gain delta and respective positions of the identified samples;

determining a minimum gain factor from the computed gain factors associated with the identified samples;

setting the minimum gain factor to the predetermined minimum gain factor when the minimum gain factor is less than predetermined minimum gain factor; and applying the set minimum gain factor for the current block of samples.

8. A system comprising:

a processor;

memory coupled to the processor; wherein the memory includes a peak limiting module to:

determine a position of a sample with highest magnitude within a current block of samples of a speech signal;

determine a peak gain to be applied for the block of samples for bringing the highest magnitude to a predetermined threshold value;

compute a gain delta by which an old gain is updated to the peak gain;

compute a gain factor for the current block of samples based on the position of the sample with highest magnitude and the gain delta;

set the gain factor to a predetermined minimum gain factor when the computed gain factor is less than the predetermined minimum gain factor; and apply gain to the current block of samples of the speech signal using the gain factor by the processor.

9. The system of claim 8, wherein the peak limiting module computes the gain delta using the equation:

$$\text{gain delta}=\text{peak gain}/\text{old gain},$$

wherein the old gain refers to a gain at the end of previous block of samples.

10. The system of claim 8, wherein the peak limiting module computes the gain factor using the equation:

$$\text{gain factor} = \text{gain delta}^{\frac{1}{\text{peak index}}},$$

wherein the gain factor refers to a factor by which gain values get updated, the gain delta refers to a fractional change in gain, and the peak index is an index value of the position of the sample with highest magnitude.

11. The system of claim 8, wherein the peak limiting module is further configured to:

determine whether the peak gain is reached in the current block of samples;

if the peak gain is not reached in the current block of samples, update the gain at each sample in the current block of samples based on the gain factor;

apply the updated gain to each sample in the current block of samples; and repeat the steps of determining, updating and applying until the peak gain is reached.

12. The system of claim 11, wherein the peak limiting module is further configured to apply the gain to remaining samples in the current block of samples upon the peak gain is reached in the current block of samples.

13. The system of claim 8, wherein the peak limiting module is further configured to:

determine whether the gain factor is equal to the predetermined minimum gain factor; and when the gain factor is not equal to the predetermined minimum gain factor, identify samples till a peak index that are crossing the predetermined threshold value upon applying the gain to the current block of samples;

compute a gain delta for each of the identified samples based on corresponding/respective magnitudes of the identified samples;

compute a gain factor for each of the identified samples based on the computed gain delta and respective positions of the identified samples;

determine a minimum gain factor from the computed gain factors associated with the identified samples;

set the minimum gain factor to the predetermined minimum gain factor when the minimum gain factor is less than predetermined minimum gain factor; and apply the set minimum gain factor for the current block of samples.

14. A non-transitory computer-readable storage medium for peak-limiting of a speech signal for delay sensitive voice communication, having instructions that, when executed by a computing device, cause the computing device to:

determine a position of a sample with highest magnitude within a current block of samples of the speech signal;

determine a peak gain to be applied for the block of samples for bringing the highest magnitude to a predetermined threshold value;

compute a gain delta by which an old gain is updated to the peak gain;

compute a gain factor for the current block of samples based on the position of the sample with highest magnitude and the gain delta;

set the gain factor to a predetermined minimum gain factor when the computed gain factor is less than the predetermined minimum gain factor;

apply gain to the current block of samples of the speech signal using the gain factor by the processor.

15. The non-transitory computer-readable storage medium of claim 14, wherein the gain delta is computed using the equation:

$$\text{gain delta}=\text{peak gain}/\text{old gain},$$

wherein the old gain refers to a gain at the end of previous block of samples.

16. The non-transitory computer-readable storage medium of claim 14, wherein the gain factor is computed using the equation:

$$\text{gain factor} = \text{gain delta}^{\frac{1}{\text{peak index}}},$$

wherein the gain factor refers to a factor by which gain values get updated, the gain delta refers to a fractional change in gain, and the peak index is an index value of the position of the sample with highest magnitude.

17. The non-transitory computer-readable storage medium of claim 14, further comprising:

determining whether the gain factor is equal to the predetermined minimum gain factor; and when the gain factor is not equal to the predetermined minimum gain factor, identifying samples till a peak index that are crossing the predetermined threshold value upon applying the gain to the current block of samples;

computing a gain delta for each of the identified samples based on corresponding/respective magnitudes of the identified samples;

computing a gain factor for each of the identified samples based on the computed gain delta and respective positions of the identified samples;

determining a minimum gain factor from the computed gain factors associated with the identified samples;

setting the minimum gain factor to the predetermined minimum gain factor when the minimum gain factor is less than predetermined minimum gain factor; and applying the set minimum gain factor for the current block of samples.

18. The non-transitory computer-readable storage medium of claim 14, wherein applying the gain to the current block of samples comprises:

determining whether the peak gain is reached in the current block of samples;

if the peak gain is not reached in the current block of samples, updating the gain at each sample in the current block of samples based on the gain factor;

applying the updated gain to each sample in the current block of samples; and repeating the steps of determining, updating and applying until the peak gain is reached.

19. The non-transitory computer-readable storage medium of claim 18, further comprising:

upon the peak gain is reached in the current block of samples, applying the gain to remaining samples in the current block of samples.

* * * * *